US011318737B2

(12) United States Patent
Korthuis et al.

(10) Patent No.: US 11,318,737 B2
(45) Date of Patent: May 3, 2022

(54) FLUIDIC DIE WITH FIRE SIGNAL ADJUSTMENT

(71) Applicant: Hewlett-Packard Development Company, L.P., Spring, TX (US)

(72) Inventors: Vincent C. Korthuis, Corvallis, OR (US); Rodrigo N. Henriquez, Corvallis, OR (US); Eric T. Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/052,923

(22) PCT Filed: Jul. 2, 2018

(86) PCT No.: PCT/US2018/040605
§ 371 (c)(1),
(2) Date: Nov. 4, 2020

(87) PCT Pub. No.: WO2020/009687
PCT Pub. Date: Jan. 9, 2020

(65) Prior Publication Data
US 2021/0229427 A1 Jul. 29, 2021

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC ..... B41J 2/04546; B41J 2/04541; B41J 2/04543; B41J 2/04506; B41J 2/04598; B41J 2/04586
See application file for complete search history.

(56) References Cited

U.S. PATENT DOCUMENTS

| | | | |
|---|---|---|---|
| 5,053,790 | A | 10/1991 | Stephenson et al. |
| 5,469,203 | A | 11/1995 | Hauschild |
| 6,183,056 | B1 | 2/2001 | Corrigan et al. |
| 6,302,507 | B1 | 10/2001 | Prakash et al. |
| 6,378,973 | B1 | 4/2002 | Kubota et al. |
| 6,422,676 | B1 | 7/2002 | Torgerson et al. |

(Continued)

FOREIGN PATENT DOCUMENTS

| | | | |
|---|---|---|---|
| CA | 2451629 | A1 | 12/2002 |
| WO | WO-2016142645 | A1 | 9/2016 |

*Primary Examiner* — Lam S Nguyen
(74) *Attorney, Agent, or Firm* — Dicke Billig & Czaja PLLC

(57) ABSTRACT

A fluidic die includes primitives arranged to form a number of primitive zones, each primitive zone including a memory to store adjustment data, and at least one signal adjuster to receive a fire signal, and to adjust the received fire signal based on the stored adjustment data to provide an adjusted fire signal to each primitive of the primitive zone. The fluidic die includes an address bus and a set of data lines, each data line corresponding to a different one of the primitives. Mode circuitry directs address data from the address bus to each primitive and print data from each data line to the corresponding primitive when a mode signal has a first value, and directs data representing adjustment data from one of the address bus and the set of data lines to at least one of the memories when the mode signal has a second value.

15 Claims, 5 Drawing Sheets

(56) References Cited

U.S. PATENT DOCUMENTS

| | | | | |
|---|---|---|---|---|
| 6,439,697 | B1 | 8/2002 | Axtell et al. | |
| 6,536,871 | B1 * | 3/2003 | Haddick | B41J 2/1408 347/50 |
| 6,575,548 | B1 * | 6/2003 | Corrigan, III | B41J 2/04506 347/19 |
| 7,032,986 | B2 | 4/2006 | Corrigan | |
| 9,283,750 | B2 | 3/2016 | Liao et al. | |
| 2002/0113832 | A1 | 8/2002 | Kanematsu et al. | |
| 2003/0202024 | A1 * | 10/2003 | Corrigan | B41J 2/04506 347/9 |
| 2003/0202025 | A1 * | 10/2003 | Schloeman | B41J 2/04546 347/12 |
| 2005/0128233 | A1 * | 6/2005 | Barkley | B41J 2/04541 347/11 |
| 2009/0002416 | A1 | 1/2009 | Benjamin | |

* cited by examiner

FLUIDIC DIE WITH FIRE SIGNAL ADJUSTMENT

BACKGROUND

Fluidic dies may include an array of nozzles and/or pumps each including a fluid chamber and a fluid actuator, where the fluid actuator may be actuated to cause displacement of fluid within the chamber. Some example fluidic dies may be printheads, where the fluid may correspond to ink.

Figure 1:
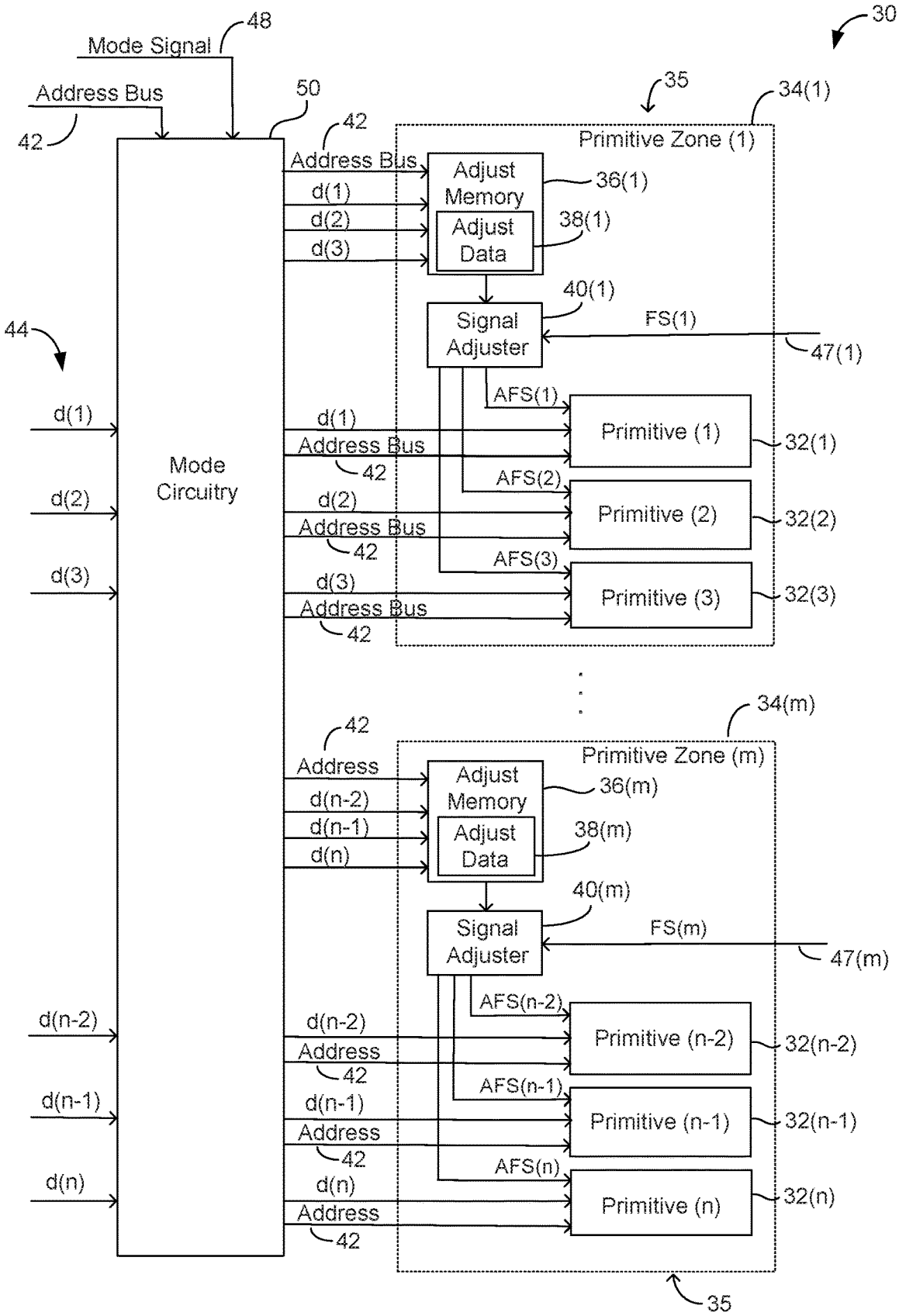
FIG. 1 is a block and schematic diagram illustrating a fluidic die, according to one example.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Examples of fluidic dies may include fluid actuators. The fluid actuators may include thermal resistor based actuators, piezoelectric membrane based actuators, electrostatic membrane actuators, mechanical/impact driven membrane actuators, magneto-strictive drive actuators, or other suitable devices that may cause displacement of fluid in response to electrical actuation. Fluidic dies described herein may include a plurality of fluid actuators, which may be referred to as an array of fluid actuators. An actuation event or firing event, as used herein, may refer to singular or concurrent actuation of fluid actuators of the fluidic die to cause fluid displacement.

In example fluidic dies, the array of fluid actuators may be arranged in sets of fluid actuators, where each such set of fluid actuators may be referred to as a "primitive" or a "firing primitive." The number of fluid actuators in a primitive may be referred to as a size of the primitive. The set of fluid actuators of a primitive generally have a set of actuation addresses with each fluid actuator corresponding to a different actuation address of the set of actuation addresses. In some examples, electrical and fluidic constraints of a fluidic die may limit which fluid actuators of each primitive may be actuated concurrently for a given actuation event. Primitives facilitate addressing and subsequent actuation of fluid actuator subsets of a fluidic die that may be concurrently actuated for a given actuation event to conform to such constraints.

To illustrate by way of example, if a fluidic die comprises four primitives, with each primitive including eight fluid actuators (with each fluid actuator corresponding to different one of the addresses 0 to 7), and where electrical and fluidic constraints limit actuation to one fluid actuator per primitive, a total of four fluid actuators (one from each primitive) may be concurrently actuated for a given actuation event. For example, for a first actuation event, the respective fluid actuator of each primitive corresponding to address "0" may be actuated. For a second actuation event, the respective fluid actuator of each primitive corresponding to address "5" may be actuated. As will be appreciated, these examples are provided merely for illustration purposes, such that fluidic dies contemplated herein may comprise more or fewer fluid actuators per primitive and more or fewer primitives per die.

Example fluidic dies may include fluid chambers, orifices, and/or other features which may be defined by surfaces fabricated in a substrate of the fluidic die by etching, microfabrication (e.g., photolithography), micromachining processes, or other suitable processes or combinations thereof. Some example substrates may include silicon based substrates, glass based substrates, gallium arsenide based substrates, and/or other such suitable types of substrates for microfabricated devices and structures. As used herein, fluid chambers may include ejection chambers in fluidic communication with nozzle orifices from which fluid may be ejected, and fluidic channels through which fluid may be conveyed. In some examples, fluidic channels may be microfluidic channels where, as used herein, a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.), such as to/from ejection chambers, for instance.

In some examples, a fluid actuator may be arranged as part of a nozzle where, in addition to the fluid actuator, the nozzle includes an ejection chamber in fluidic communication with a nozzle orifice. In such case, the fluid actuator is positioned relative to the fluid chamber such that actuation of the fluid actuator causes displacement of fluid within the fluid chamber that may cause ejection of a fluid drop from the fluid chamber via the nozzle orifice. Accordingly, a fluid actuator arranged as part of a nozzle may sometimes be referred to as a fluid ejector or an ejecting actuator.

In one example nozzle, the fluid actuator comprises a thermal actuator which is spaced from the fluid chamber by an insulating layer, where actuation (sometimes referred to as "firing") of the fluid actuator heats the fluid to form a gaseous drive bubble within the fluid chamber that may cause a fluid drop to be ejected from the nozzle orifice, after which the drive bubble collapses. In some examples, a cavitation plate is disposed within the fluid chamber so as to be above the fluid actuator and in contact with the fluid within the chamber, where the cavitation plate protects material underlying the fluid chamber, including the underlying insulating material and fluid actuator, from cavitation forces resulting from generation and collapse of the drive bubble. In examples, the cavitation plate may be metal (e.g., tantalum).

In some examples, a fluid actuator may be arranged as part of a pump where, in addition to the fluidic actuator, the pump includes a fluidic channel. The fluidic actuator is positioned relative to a fluidic channel such that actuation of the fluid actuator generates fluid displacement in the fluid channel (e.g., a microfluidic channel) to convey fluid within the fluidic die, such as between a fluid supply (e.g., fluid slot) and a nozzle, for instance. A fluid actuator arranged to convey fluid within a fluidic channel may sometimes be referred to as a non-ejecting actuator. In some examples, similar to that described above with respect to a nozzle, a metal cavitation plate may be disposed within the fluidic channel above the fluid actuator to protect the fluidic actuator and underlying materials from cavitation forces resulting from generation and collapse of drive bubbles within the fluidic channel.

Fluidic dies may include an array of fluid actuators (such as columns of fluid actuators), where the fluid actuators of the array may be arranged as fluid ejectors (i.e., having corresponding fluid ejection chambers with nozzle orifices) and/or pumps (having corresponding fluid channels), with selective operation of fluid ejectors causing fluid drop ejection and selective operation of pumps causing fluid displacement within the fluidic die. In some examples, the array of fluid actuators may be arranged into primitives.

In example fluidic dies, each primitive may share a same set of addresses, with each fluid actuator of a primitive corresponding to a different address of the set of addresses. In examples, primitives may be arranged in columns (such as along fluid channels communicating fluid to the fluid chambers, for instance), with the primitives of a columns each having a corresponding data line, and a column of primitives together sharing an address line (e.g., an address bus), a fire signal line, and a power line.

According to one example, during an actuation event, an address is driven on the address bus (e.g., an address 0-7 in the case of primitives of the column having up to 8 actuators) and actuation or firing data (e.g., an actuation bit having a value of "0" or "1") is driven on the data line for each primitive. For each primitive, the fluid actuator corresponding to the address on the address bus is actuated or fired based on the firing data on the corresponding data line. For example, a fluid actuator corresponding to the address on the address bus may be fired when the corresponding data line has an actuation or fire bit having a value of "1", for instance.

In one example, the fire signal line communicates a fire signal having one or more pulses. During a firing event, for a fluid actuator corresponding to the address on the address bus and with a corresponding data line having an actuation bit in an active state (e.g., a value of "1"), the fluid actuator is actuated or fired by connecting the fluid actuator to a power line (e.g., a voltage bus) such as via a controllable switch, for example, for a duration determined by a duration of the one or more pulses of the fire signal.

In some examples, a fire signal may include a fire pulse having a duration that energizes a fluid actuator long enough to cause fluid to be displaced (e.g., fluid ejection in the case of a nozzle). In some examples, a fire signal may include a fire pulse and a precursor pulse, where the precursor pulse precedes a fire pulse and has a duration that energizes a fluid actuator long enough to warm a fluid, for example, but not long enough for fluid to be displaced. Warming fluid prior to displacement, such as to cause a fluid drop to be ejected from a nozzle, for example, may reduce variations in drop size or an amount of fluid displacement during different actuation events by a same fluid actuator or between different fluid actuators. In examples, an amount of energy provided to a fluid actuator during an actuation event is based on a duration of the fire pulse and/or precursor pulse.

Because physical locations of the primitives on the fluidic die vary, parasitic resistances along power lines may vary from primitive-to-primitive. In one example, for instance, when arranged in a column and being provided with power from a voltage bus disposed at each end of the column (e.g., the top and bottom), the closer a primitive is to a center of the column the greater an associated parasitic resistance along the power lines. As a result, due to differing energy losses caused by the differing parasitic resistances, for a same fire signal, differing amounts of energy may be delivered to fluid actuators of different primitives during actuation events. Consequently, fluid ejectors of different primitives may undesirably eject fluid drops of different sizes (e.g., ink drops) in response to a same fire signal.

One technique to compensate for the differing parasitic resistances so that a same amount of energy may be delivered to fluid actuators of each primitive during actuation events includes arranging primitives into a number of primitive zones, where primitives of a given primitive zone have similar parasitic resistances along a power line or path. In some examples, each such primitive zone includes an adjust memory storing adjustment data, and at least one fire signal adjuster that adjusts the fire signal based on the stored adjustment data to provide an adjusted fire signal to the primitives of the zone. In one example, the fire signal adjuster adjusts the fire signal by adjusting a duration of the fire pulse and/or the precursor pulse (e.g., trimming or extending a duration). By adjusting the fire signal of each primitive zone, an amount of energy delivered to the fluid actuators of each primitive zone can be separately adjusted so that a same energy is provided to the fluid ejectors of each primitive (e.g., each primitive of a column of primitives) such that the fluid ejectors of each primitive generate a same drop size, for instance.

While such technique enables control over an amount of energy delivered to the fluid actuators of each primitive zone, required circuitry consumes limited space on the fluidic die.

FIG. 1 is a block and schematic diagram generally illustrating a fluidic die 30, in accordance with one example of the present disclosure, including a plurality of primitives arranged to form primitive zones, with each primitive zone having an adjust memory to store adjustment data and at least one fire signal adjuster to adjust a fire signal based on the stored adjustment data. According to examples, which will be described herein, during actuation events, an address bus and data lines respectively communicate address and fire data to primitives, but during a program mode, as indicated by a status of a program signal communicated on a program line, one of the address bus and data lines are used to communicate adjust data to the adjust memories. By using the address bus and data lines to carry address and actuation data to the primitives during actuation events, and using one of the address bus and data lines to carry adjustment data to the adjust memories of primitive zones during a program mode, dedicated lines are not required to provide adjustment data to the adjust memory of each primitive zone, thereby conserving space on the fluidic die.

According to one example, fluidic die 30 includes a plurality of primitives 32, illustrated as primitives 32(1) to 32(*n*). In one example, each primitive 32 includes a plurality of fluid actuators (e.g., see FIG. 2), where each fluid actuator may be arranged as part of a nozzle or a pump. In examples, primitives 32 are arranged to form a number of primitive zones 34, illustrated as primitive zones 34(1) to 34(*m*). Although illustrated in FIG. 1 as each having three primitives 32, in other examples, primitive zones 34 may have any number of primitives 32, and different primitive zones 34 may have different numbers of primitives 32. In one example, primitive zones 34 may be arranged to form a column 35 of primitive zones 34 on fluidic die 30.

According to examples, each primitive zone 34 has an adjust memory 36 to store adjust data 38, illustrated as adjust memories 36(1) to 36(*m*) storing adjust data 38(1) to 38(*m*), and a signal adjuster 40, illustrated as signal adjusters 40(1) to 40(*m*). In some examples, each primitive zone 34 may have more than one signal adjuster 40, such as one signal adjuster 40 for each primitive 32, for instance.

An address bus 42 communicates address data to each primitive 32, and a set of data lines 44, illustrated as data lines d(1) to d(n), communicates actuation data to primitives 32, with each data line corresponding to a different one of the primitives, such as data lines d(1) to d(n) respectively corresponding to primitives 32(1) to 32(*n*). Each signal adjuster 40 of each primitive zone 34 receives a fire signal (FS) via a fire signal line 46. In one example, each signal adjuster 40 receives a uniquely time-delayed version of a same fire signal FS, illustrated as fire signals FS(1) to FS(m), such that the signal adjuster 40 of each primitive zone 34 receives the first signal, FS, at a different time.

A mode signal line 48 communicates a mode signal (MS) having a first value (e.g., a value of "0") and a second value (e.g., a value of "1"). In one example, a mode signal having a value of "1" is indicative of a program mode, while a mode signal having value of "0" indicates a non-program mode. According to examples, based on a value of the mode signal on mode signal line 48, mode circuitry 50 respectively directs either address and actuation data to primitives 32 of each primitive zone via address bus 43 and data lines d(1) to d(n), or directs data representing adjustment data 38 from one of the address bus 42 and the set of data lines 44 to at least one of the adjust memories 36.

For example, in one case, during a firing operation of fluidic die 30, mode signal 48 has a value of "0" and mode circuitry 50 directs address data (e.g. addresses 0-7) to each primitive 32 via address bus 42, and directs actuation data to each primitive 32(1) to 32(*n*) via its corresponding data line d(1) to d(n). Each signal adjustor 40(1) to 40(*m*) adjusts the fire signal based on its corresponding adjustment data 38(1) to 38(*m*) to respectively provide an adjusted fire signal AFS to each primitive 32 of its corresponding primitive zone 34(1) to 34(*m*). In one example, signal adjuster 40 provides a uniquely time-delayed adjusted fire signal to each primitive 32 of its corresponding primitive zone 34, such as illustrated by signal adjuster 40(1) providing adjusted fire signals AFS(1) to AFS(3) to primitives 32(1) to 32(3). For each primitive 32, as described above, a fluid actuator corresponding to the address on data bus 42 and having an actuation value (or fire value) on its corresponding data line (e.g., a value of "1") will actuate (or fire) for a duration based on its corresponding adjusted fire signal.

By providing a differently adjusted fire signals to each primitive zone 34(1) to 34(*m*), a same amount of energy may be provided to the fluid actuators of each primitive 32 of each primitive zone 34. For instance, in the example of FIG. 1, the fluid actuators of primitives 32(1) to 32(3) of primitive zone 34(1) may be provided with a same actuation energy as fluid actuators of primitives of all other primitives zones, such as the fluid actuators of primitives 32(*n*−2) to 32(*n*) of primitive zone 32(*m*), for example, such that the fluid actuators of the column 35 of primitive zones 34 receive a same amount of actuation energy. Additionally, by providing uniquely time-delayed adjusted fire signals to primitives 32 enables fluidic die 30 to operate within potential fluidic and electrical power constraints (as described above).

According to examples, when the mode signal on mode signal line 48 is indicative of a program mode of fluidic die 30 (e.g., when the mode signal has a value of "1"), mode circuitry 50 directs data representing adjustment data 38 from one of the address bus 42 and the set of data lines 44 to at least one of the adjust memories 36. For instance, in one example, as described in greater detail below (e.g., see FIG. 2), during a program mode, for each primitive zone 34, mode circuitry 50 directs data representing adjustment data 38 to the adjust memory 36 of each primitive zone 34 from one or more of the data lines corresponding to the primitive zone (e.g., adjustment data 38(1) directed to adjust memory 36(1) from at least one of the corresponding data lines d(1) to d(3), and adjustment data 38(*m*) directed to adjust memory 36(*m*) from one or more of the corresponding data lines d(n−2) to d(n)).

In another example, as will be described in greater detail below (e.g., see FIG. 3), during a program mode, for each primitive zone 34, mode circuitry 50 directs data representing adjustment data 38 to the adjust memory 36 of one or more primitive zones 34 from address bus 42 (e.g., adjustment data 38(1) directed to adjust memory 36(1) from address bus 42).

Figure 2:
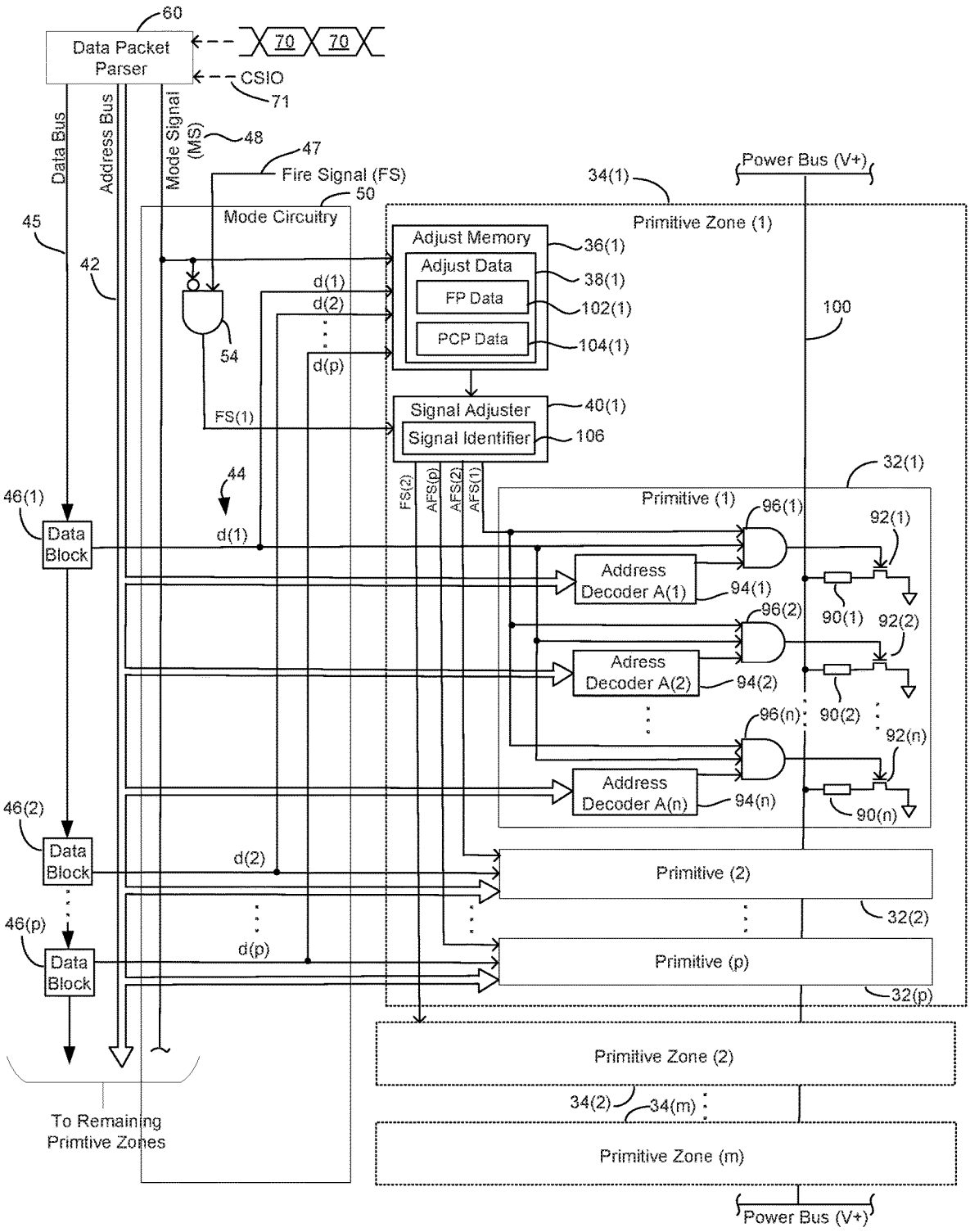
FIG. 2 is a block and schematic diagram illustrating a fluidic die, according to one example.

FIG. 2 is a block and schematic diagram generally illustrating portions of a fluidic die 30, in accordance with one example of the present disclosure, where the set of data lines 44 communicates actuation data to primitives 32 during actuation events and communicates adjustment data 38 to adjust memories 36 during a program mode. In one example, as illustrated, for each primitive zone 34, in addition to connecting corresponding data lines to the primitives 32 thereof, mode circuitry 50 connects up to all of the data lines for the primitive zone 32 to the corresponding adjust memory 36. For example, in FIG. 2, with regard to primitive zone 34(1), mode circuitry 50 respectively connects data lines d(1) to d(p) to primitives 32(1) to 32(*p*) and to adjust memory 36(1).

Additionally, according to one example, for each primitive zone 34, mode circuitry 50 connects mode signal line 48 to adjust memory 36, where the mode signal (MS) serves as a load enable signal for adjust memory 36. As will be described below, according to one example, when MS has an enable value (e.g., a value of "1"), adjust memory 36 loads data representing adjust data 38 from the corresponding data lines.

In one example, mode circuitry 50 includes a fire signal gate 54 which has fire signal (FS) and inverted mode signal (MS) as inputs. When the mode signal has an enable value (e.g., a value of "1"), meaning that fluidic die 30 is in a program mode, fire signal gate 54 disables the FS (i.e., does not pass the FS to primitive zones 34). Conversely, when the mode signal has a disable value (e.g. a value of "0"), meaning that the fluidic die 30 is in a non-program mode, fire signal gate 54 enables the FS (i.e., passes the FS to primitive zones 34). In one example, as illustrated, fire signal gate 54 provides the fire signal, illustrated as FS(1), to signal adjuster 40(1) of primitive zone (1). In one example, each signal adjuster 40 provides a time-delayed version of the received fire signal to the signal adjuster 40 of the next primitive zone 34 so that each primitive zone 34 receives the fire signal at a different time, such as signal adjuster 40(1) providing a time-delayed version of FS(1) to signal adjuster 40(2) of primitive zone 34(2) in the form of fire signal FS(2).

In one example, fluidic die 30 includes a data packet parser 60 to receive data packets 70 (such as from a controller separate from fluid die 30, e.g.) which may include address data, actuation data, and adjustment data.

Figure 3:
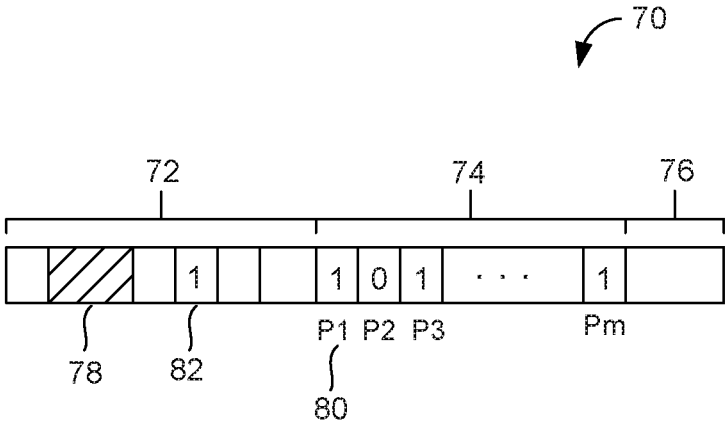
FIG. 3 is a schematic diagram illustrating a data packet, according to one example.

FIG. 3 is a block diagram generally illustrating an example data packet 70 (also sometimes referred to as a fire pulse group (FPG)). Data packet 70 includes a header portion 72, a data portion 74, and a footer portion 76. According to one example, header portion 72 includes address bits 78 indicative of the set of addresses employed by fluid actuators of primitives 32, such as the set of addresses A(1) to A(n), for instance. In one example, data portion 74 includes a series of data bits 80, where each data bit 80 corresponds to a different one of the primitives P1 to Pm. As will be described in greater detail below, in one case, data bits 80 may represent actuation data for controlling the fluid actuators of primitives 32 and, in another case, may represent adjustment data 38 for adjust memories 36 of primitive zones 34.

In one example, as described in greater detail below, header portion 72 may include program data 82, such as a program data bit 82, where a program data bit 82 having a value of "1" is indicative of a program mode such that data bits 80 in data portion 74 are representative of adjustment data 38, and a program bit 82 having a value of "0" is indicative of a non-program mode such that data bits 80 are representative of actuation data for fluid actuators of primitives 32. Although described in terms of a data bit, in other examples, program data 82 may include more than one bit and represent more than one binary value.

In another example, in lieu of a program bit 82 in a header portion 72 of data packets 70, data packet parser 60 may receive indication of a program mode via a communication channel 71 (e.g., a serial I/O channel). In one such case, when communication channel 71 has indicated a program mode, data bits 80 in the data portion 74 of a corresponding data packet 70 represents adjustment data 38 for communication to adjustment memories 36.

Returning to FIG. 2, according to one example, each primitive zone 34 has a plurality of primitives 32, indicated as primitives 32(1) to 32(*p*) in the illustrated example. In one example, each primitive 32 includes a plurality of fluid actuators 90, such as illustrated by fluid actuators 90(1) to 90(*n*) of primitive 32(1). In one example, each fluid actuator 90 is connected to a power bus 100 and connectable to a reference potential (e.g., ground) so as to be energized via a controllable switch 92 (e.g., a FET), illustrated as switches 92(1) to 92(*n*). It is noted that other circuit topologies may be employed for energizing fluid actuators 90.

In examples, each fluid actuator 90 of a primitive 32 corresponds to a different address of a set of addresses employed by each primitive 32, such as addresses A(1) to A(n), for example, and has a corresponding address decoder 94, illustrated as 94(1) to 94(*n*), to decode the address corresponding to the fluid actuator 92 when such address is present on address bus 42. According to one example, each fluid actuator 90 has a corresponding AND-gate 96, illustrated as AND-gates 96(1) to 96(*n*), with each AND-gate 96 receiving as an input adjusted fire signal (AFS) from signal adjust 40 of the corresponding primitive zone 34, data from the data line for the primitive 32 to which the fluid actuator 90 belongs, and an output from the corresponding address decoder 94. An output of AND-gate 96 is connect to and controls controllable switch 92.

Signal adjuster 40 of each primitive zone 34 adjusts its corresponding FS based on adjust data 38 stored in corresponding adjust memory 36, such as signal adjuster 40(1) of primitive zone 34(1) adjusting FS(1) based on adjust data 38(1) stored in adjust memory 36(1).

Figure 4:
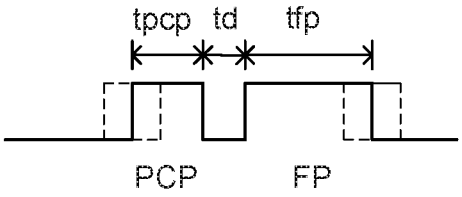
FIG. 4 is a schematic diagram illustrating a fire signal, according to one example.

FIG. 4 is a timing diagram generally illustrating a fire signal, FS, according to one example. In some examples, FS includes a fire pulse (FP) having a duration, tfp, that energizes a fluid actuator 90 long enough to cause fluid to be displaced (such as ejection of fluid in that case of a nozzle). In some examples, FS also includes a precursor pulse (PCP) which precedes and is separated from the FP by a dead time, td, and has a duration, tpcp, to energize a fluid actuator long to warm a fluid, but not long enough for fluid to be displaced. Warming a fluid prior to displacement via energization of a fluid actuator in response to a FP may reduce variations in an amount of fluid displaced during different actuation events by a same fluid actuator 90 or between different fluid actuators. Adjusting a duration, tfp, of a FP and/or a duration, tpcp, of a PCP adjusts an amount of energy delivered to a fluid actuator 90.

Returning to FIG. 2, in one example, adjust data 38 of each primitive zone 34 includes fire pulse (FP) data, such as FP data 102(1), for adjusting a FP of the fire signal (FS). In one example, adjust data 38 of each primitive 34 includes precursor pulse (PCP) data, such as PCP data 104(1) for adjusting a PCP pulse of the fire signal (see FIG. 4). In one example, as illustrated, adjust data of each primitive 34 includes both FP data 102(1) and PCP data 104(1).

In one case, signal adjuster 40 may adjust the fire signal by adjusting a duration of a FP based on FP data 102 (shortening or lengthening the duration, tfp, such as illustrated by the dashed lines in FIG. 4) to provide the adjusted fire signal (AFS). In one case, signal adjuster 40 may adjust the fire signal by adjusting a duration of a PCP based on PCP data 104 (shortening or lengthening the duration, tpcp, such as illustrated by the dashed lines in FIG. 4) to provide the AFS. In another case, signal adjuster 40 may adjust a duration of both a PCP and a FP based respectively on PCP data 104 and FP data 102 to provide the AFS. In one example, FP data 102 and PCP data 104 represent a clock cycle count by which the signal adjuster 40 is to respectively adjust the FP and PCP durations (i.e., shorten the duration or extend the duration).

In one example, each signal adjuster 40 includes a signal identifier 106, such as signal identifier 106(1) of signal adjuster 40(1). When the FS includes both a PCP and an FP, signal identifier 106 identifies which type of pulse has been received so that signal adjuster 40 can apply the correct adjust data 36. In one example, signal identifier 106 includes a flip-flop which changes state upon receiving a leading edge of each pulse such that the flip-flop provides a first state upon receiving a PCP and a second state up on receiving a FP, for instance.

In operation, according to one example, data packet parser 60 receives a data packet 70. In one case, if data packet 70 includes program data 82 which is indicative of a non-program mode (e.g., program bit 82 has an inactive value, such as a value of "0"), or if data packet 70 does not include program data in header portion 72 and communication channel 71 has not indicated a program mode, data packet parser 60 identifies the received data packet 70 as containing actuation data. In such case, data packet parser 60 drives the address data 78 from data packet 70 (see FIG. 3) on address bus 42 and drives each actuation data bit 80 (see FIG. 3) on the data line for the primitive 32 to which the actuation data bit 80 corresponds (e.g., one of data lines d(1) to d(n)).

In one example, as illustrated, data packet parser 60 serially loads the series of actuation data bits 80 from data portion 74 of data packet 70 onto a serial data bus 45 such that each actuation data bit 80 is loaded into a data block 46 corresponding to the primitive 32 to which the actuation data bit 80 corresponds (illustrated as data blocks 46(1) to 46(*p*) in FIG. 2). Each of the data blocks 46, in-turn, communicates actuation data bit 80 to the corresponding primitive 32 via the corresponding data line (illustrated as data lines d(1) to d(p) in FIG. 2) of the set of data lines 44.

In such an actuation mode, data packet parser 60 communicates mode signal (MS) having a disable value (e.g., a value of "0") on mode signal line 48. Mode circuitry 50 communicates the mode signal (MS) to adjust memory 36. With MS having a disable value, adjust memory 36 does not load data from the corresponding data lines, such as from data lines d(1) to d(p) for adjust memory 36(1). Further, with MS having a disable value, fire signal gate 54 enables the FS on fire signal line 47 to be communicated to the signal adjuster 40 of each primitive zone 34, such as to signal adjuster 40(1) of primitive zone 34(1) receiving fire signal FS(1). In one example, as described above, each signal adjuster 40 of each primitive zone 34 provides a time delayed fire signal to the signal adjuster of the next primitive zone, such as signal adjuster 40(1) of primitive zone 34(1) providing fire signal FS(2) to primitive zone 34(2). In response, each signal adjuster 40 of each primitive zone 34 adjusts a duration of the PCP and/or FP based on the respective PCP data 104 and FP data 102 stored in adjust memory 38 to provide an AFS, such as signal adjuster 40(1) of primitive zone 34(1) adjusting FS(1) received from fire signal gate 54 based on adjustment data 38(1) of adjust memory 36(1) to provide AFS(1) to AFS(p) to primitives 32(1) to 32(*p*), for example.

For each primitive 32, for a fluid actuator 90 having its corresponding address on address bus 42 and having actuation data on its corresponding data line, the output of its corresponding AND-gate 96 will pass the AFS to its corresponding switch 92 to connect the fluid actuator 90 to power bus 100 and thereby energize fluid actuator 90 with an amount of energy determined by the durations of the PCP and FP of the AFS to displace fluid (e.g., to eject a fluid drop in the case of fluid actuator 90 being part of a nozzle). For example, if address A(1) is on the address bus, the output of address decoder A(1) corresponding to fluid actuator 90(1) will provide an active output to AND-gate 96(1). If actuation data is also present on data line d(1), the output of AND-gate 96 will close switch 92(1) to energize fluid actuator 90(1) based on AFS(1).

In another example, if data packet parser 60 receives a data packet 70 including program data 82 which is indicative of a program mode (e.g., program bit 82 has a value of "1"), or if data packet 70 does not include program data in header portion 72, but communication channel 71 has indicated a program mode, data packet parser 60 identifies the received data packet 70 as containing adjustment data 38. In such case, address data 78 is ignored, and data packet parser 60 places each data bit 80 (see FIG. 3), which represent adjustment data 38, on the one of the data lines d(1) to d(n) corresponding to the primitive 32 to which the data bit 80 corresponds.

In program mode, data packet parser 60 communicates mode signal (MS) having an enable value (e.g., a value of "1") on mode signal line 48. With MS having an enable value, fire signal gate 54 blocks the FS from being communicated to signal adjuster 40 of each primitive zone 34, such as to signal adjuster 40(1) of primitive zone 34(1). Additionally, mode circuitry 50 communicates the mode signal (MS) to adjust memory 36. With MS having an enable value, adjust memory 36 loads data from the data lines corresponding to its primitive zone 34, such adjust memory 36(1) loading adjust data from data lines d(1) to d(p) for adjust memory 36(1) of primitive zone 34(1).

In one example, a first portion of the data lines corresponding to each adjust memory 36 may carry FP data 102, and a second portion of the data lines corresponding to each adjust memory 36. For example, a first portion of data lines d(1) to d(p) may carry FP data 102(1) and a second portion of data lines d(1) to d(p) may carry PCP data 104(1) to adjust memory 36(1). In another example, FP data 102 and PCP data 104 may be carried by data lines for each primitive zone 34 in separate programming operations. For instance, data lines d(1) to d(p) may carry FP data 102(1) to adjust memory 36(1) in a first programming operation, and may carry PCP data 104(1) to adjust memory 36(1) in a second programming operation.

Although illustrated as connecting all data lines corresponding to a primitive zone 34 to adjust memory 36, in other examples, mode circuitry 50 may connect only a portion of data lines corresponding to a primitive zone 34 to adjust memory 36. For instance, in other embodiments, mode circuitry 50 may connect only a portion of data lines d(1) to d(p) of primitive zone 34(1) to adjust memory 36(1).

By using data lines, such as illustrated by FIG. 2, to communicate actuation data to fluid actuators 90 during a non-program mode of fluidic die 30, such as an actuation mode, for example, and to communicate adjustment data 38 to adjust memories 36 of primitive zones 34 during a programming mode, separate communication lines are not required to transmit adjustment data 38 to adjust memories 36, thereby conserving space on fluidic die 30. Also, by using data lines d(1) to d(n) to communicate adjustment data 38 to adjust memories 36, unique adjust data 38 can be simultaneously loaded into the adjust memories 36 of each primitive zone 34.

Figure 5:
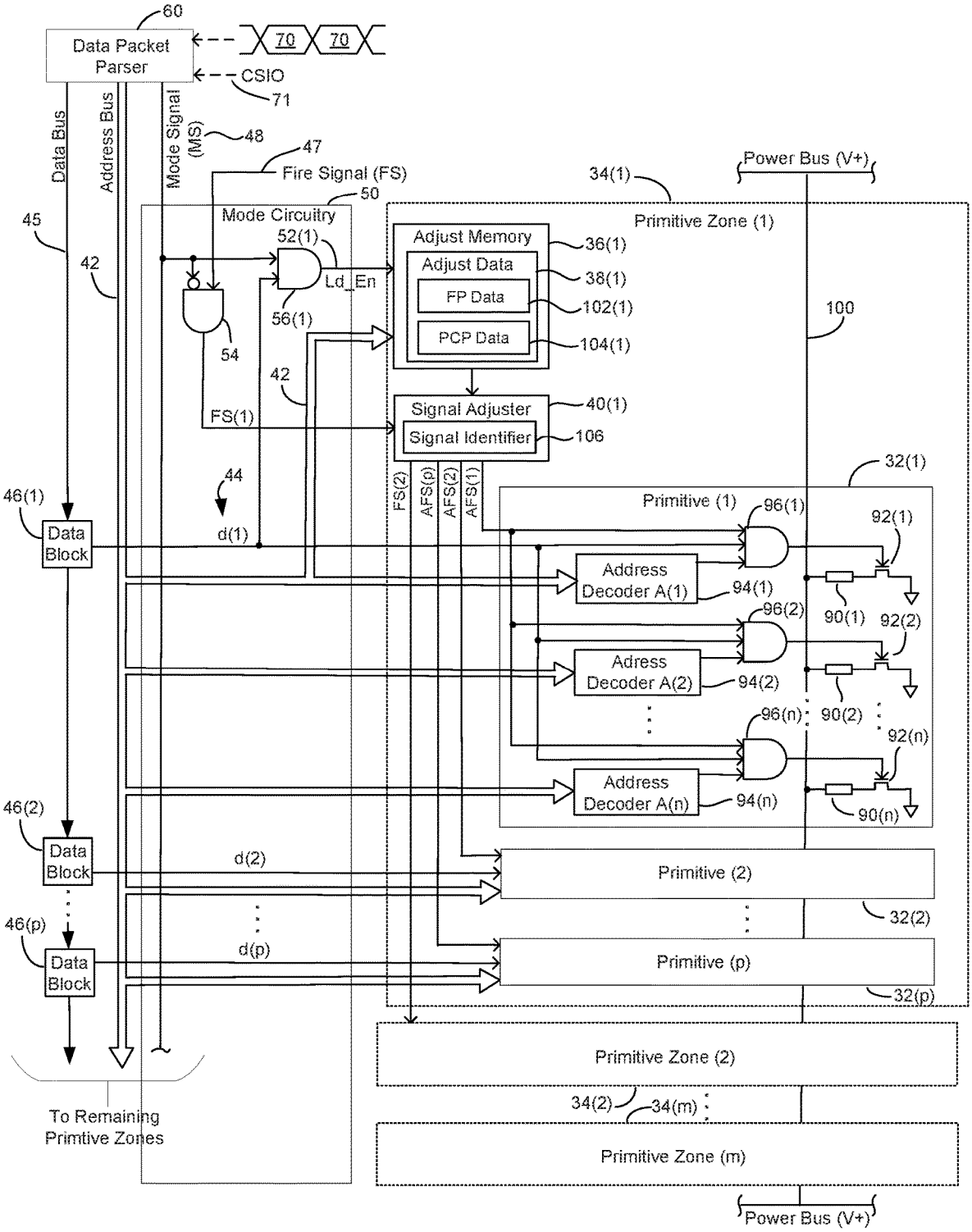
FIG. 5 is a block and schematic diagram illustrating a fluidic die, according to one example.

FIG. 5 is a block and schematic diagram generally illustrating portions of a fluidic die 30, in accordance with one example of the present disclosure, where data bus 42 communicates actuation data to primitives 32 during actuation events and communicates adjustment data 38 to adjust memories 36 during a program mode. In one example, as illustrated, for each primitive zone 34, in addition to connecting address bus 42 to the primitives 32 thereof, mode circuitry 50 connects address bus 42 to adjust memory 36. For example, in FIG. 2, with regard to primitive zone 34(1), mode circuitry 50 respectively connects address bus 42 to primitives 32(1) to 32(*p*) and to adjust memory 36(1).

In one example, in addition to fire signal gate 54, for each primitive zone 34, mode circuitry 50 includes a load enable gate 56 having mode signal (MS) as a first input, at least one data line corresponding to the primitive zone 34 as a second input, and an output representing a load enable signal (Ld_En) to the corresponding adjust memory 36. For example, for primitive zone 34(1), mode circuitry 50 includes load enable gate 56(1) having MS as a first input and data line d(1) as a second input, with an output of load enable gate 56(1) being the load enable signal, Ld_En, to adjust memory 36(1).

During a non-program mode of fluidic die 30, such as an actuation mode, for example, the operation of the example implementation of FIG. 5 is similar to that of FIG. 2 as described above. For example, if data packet 70 received by data packer parser 60 includes program data 82 which is indicative of a non-program mode (e.g., program bit 82 has a value of "0"), or if data packet 70 does not include program data in header portion 72 and communication channel 71 has not indicated a program mode, data packet parser 60 identifies the received data packet 70 as an actuation data packet.

In such case, data packet parser 60 communicates mode signal (MS) having a disable value (e.g., a value of "0") on mode signal line 48. With MS having a disable value, the Ld_En output of load enable gate 56 is inactive such that corresponding adjust memory 36 does not load data from address bus 42, such as Ld_En output from load enable gate 56(1) on signal line 52(1) being inactive so that adjust memory 36(1) does not load data from address bus 42.

Data packet parser 60 further places address data 78 from data packet 70 (see FIG. 3) on address bus 42 and places each actuation data bit 80 on the corresponding one of the data lines d(1) to d(n), such as via serial data bus 45 and data blocks 46(1) to 46(*n*), for example. As described above with regard to FIG. 2, actuation of fluid actuators 90 in each primitive 32 then occurs based on the address (e.g., address A(1) to A(n)) on address bus 42, actuation data on data lines d(1) to d(n), and the AFS of each primitive zone 34.

If data packet parser 60 receives a data packet 70 including program data 82 which is indicative of a program mode (e.g., program bit 82 has a value of "1"), or if data packet 70 does not include program data in header portion 72, but communication channel 71 has indicated a program mode, data packet parser 60 deems fluidic die 30 to be operating in program mode and identifies the received data packet 70 as containing adjustment data 38. In one example, when in program mode, data packet parser 50 places address data 78 on address bus 42, and places each data bit 80 on the data line for the primitive to which the data bit 80 corresponds.

Additionally, data packet parser 60 communicates mode signal (MS) having an enable value (e.g., a value of "1") on mode signal line 48. With MS having an enable value, fire signal gate 54 blocks the FS from being communicated to signal adjuster 40 of each primitive zone 34, such as to signal adjuster 40(1) of primitive zone 34(1), and load enable gate 56 has an enable value at its first input.

According to the example of FIG. 5, in program mode, address data 78 of data packet 70 (see FIG. 3) represents adjustment data 38, and data bits 80 indicate primitive zones 32 whose adjust memory 36 will receive the adjustment data 38. As described above with reference to FIG. 3, each data bit 80 corresponds to different one of the primitives 32 of fluidic die 30. In one example, if a predetermined one of the data bits 80 corresponding to one of the plurality of primitives 32 of a given primitive zone 34 has an enable value (e.g., a value of "1"), the adjust memory 36 of the given primitive zone will load be enabled to load the adjust data 38 from the address bus 42. For instance, in the illustrated example of FIG. 5, the data bit 80 corresponding to primitive (1) of primitive zone (1) on data line d(1) is the predetermined data bit whose value determines whether adjust memory 36(1) will load adjust data 38 from address 42. For example, with MS having an enable value (e.g., a value of "1"), and the data bit on data line d(1) having an enable value (e.g., a value of "1"), load enable gate 56(1) provides Ld_En on signal line 52(1) having an enable value (e.g., a value of "1") that instructs adjust memory 36(1) to load adjust data 38 from address bus 42.

Although illustrated in FIG. 5 as having only one data line of primitive zone (1) is illustrated as being an input to load enable gate 56(1), that being data line d(1), in other examples, more than one data line may be used as an input to load enable gate 56. In one example, in a case of more than one data line being an input to load enable gate 56, with MS having an enable value, the data bit on each of the data lines must have an enable value for load enable gate 56 to provide Ld_En having an enable value. In another example, with MS having an enable value, at least one of the data bits on one of the multiple data lines used as inputs to load enable gate 56 must have an enable value for load enable gate 56 to provide Ld_En having an enable value.

According to the example implementation of FIG. 5, by using address bus 42 to communicate adjust data 38, the same adjust data 38 may be simultaneously loaded into adjust memories 36 of different primitive zones 34. Further, similar to the dual-purposing of data lines as described by the example of FIG. 2, by using address bus 42 to communicate address data during a non-program mode of fluidic die 30, such as an actuation mode, for example, and to communicate adjustment data 38 to adjust memories 36 of primitive zones 34 during a programming mode, separate communication lines are not required to transmit adjustment data 38 to adjust memories 36, thereby conserving space on fluidic die 30.

Figure 6:
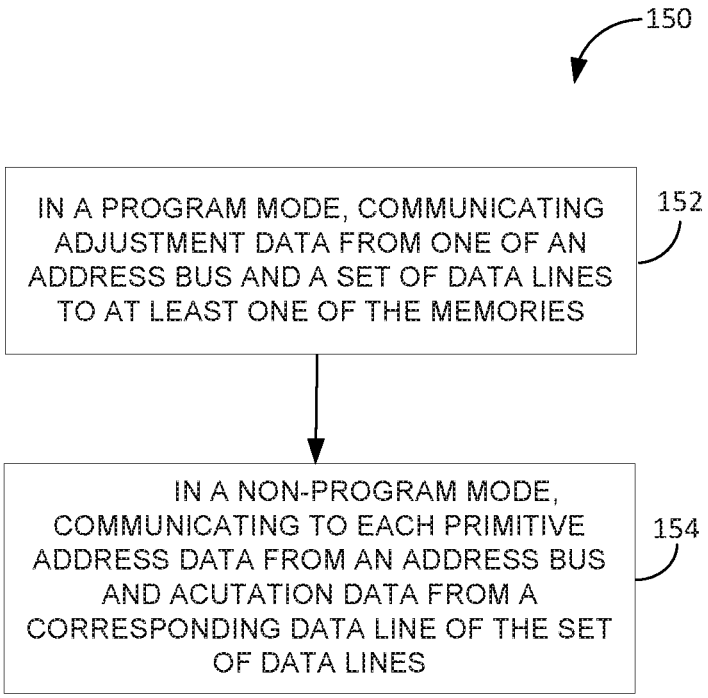
FIG. 6 is a flow diagram illustrating a method of operating a fluidic die, according to one example.

FIG. 6 is flow diagram 150 generally illustrating a method of operating a fluidic die having a plurality of primitives arranged to form a number of primitive zones, with each primitive zone including a memory to store adjustment data and having at least one signal adjuster to adjust a fire signal based on the adjustment data to provide an adjusted fire signal to each primitive of the primitive zone, such as fluid die 30 of FIG. 1 including a plurality of primitives 32(1) to 32(*n*) arranged to form a number of primitive zones 34(1) to 34(*m*), with each primitive zone 34 including a memory 36 to store adjustment data 38 and having at least one signal adjuster 40 to adjust a fire signal (FS) based on adjustment data 38 to provide an adjusted fire signal (AFS) to each primitive 32 of the primitive zone 34.

At 152, the method includes directing adjustment data from one of an address bus and a set of data lines to at least one of the memories of the primitive zones during a program mode, such as fluidic die 30 of FIG. 1 directing adjustment data 38 from one of an address bus 42 and a set of data lines 44 to at least one of the memories 36(1) to 36(*m*) of the primitive zones 34(1) to 34(*m*) during a program mode, such as indicated by a state of a mode signal (MS) on mode signal line 48.

At 154, the method includes directing address data from the address bus and actuation data to each primitive from a corresponding data line of the set of data lines during a non-program mode, such as fluidic die 30 of FIG. 1 directing address data from address bus 42 to each primitive 32(1) to 32(*n*) and actuation data to each primitive 32(1) to 32(*n*) from a corresponding data line d(1) to d(n) of the set of data lines 44 during a non-program mode, such as indicated by a state of mode signal (MS) on signal line 48.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluidic die comprising:

a plurality of primitives arranged to form a number of primitive zones, each primitive zone including:

a memory to store adjustment data; and at least one signal adjuster to:

receive a fire signal via a fire signal line; and adjust the received fire signal based on the stored adjustment data to provide an adjusted fire signal to each primitive of the primitive zone;

an address bus;

a set of data lines, each data line corresponding to a different one of the primitives; and a mode line to communicate a mode signal having a first value or a second value; and mode circuitry to direct:

address data from the address bus to each primitive and print data from each data line to the corresponding primitive when the mode signal has the first value; and direct data representing adjustment data from one of the address bus and the set of data lines to at least one of the memories when the mode signal has the second value.

2. The fluidic die of claim 1, when the mode signal has the second value, for each primitive zone, the mode circuitry to direct adjustment data to the memory from data lines corresponding to primitives of the primitive zone.

3. The fluidic die of claim 1, each data line to communicate an enable value and a disable value, when the mode signal has the second value, for each primitive zone, the mode circuitry to direct adjustment data to the memory from the address bus when any data line corresponding to a primitive of the primitive zone has an enable value.

4. The fluidic die of claim 1, the mode circuitry to disable the fire signal when the mode signal has the second value.

5. The fluidic die of claim 1, each primitive zone including a plurality of signal adjusters, each adjuster of the plurality of signal adjusters corresponding to a different primitive of the primitive zone.

6. The fluidic die of claim 1, the fire signal including a precursor pulse and a fire pulse, the adjustment data including at least one of precursor pulse data representative of how to adjust a duration of the precursor pulse and fire pulse data representative of how to adjust a duration of the fire pulse.

7. The fluidic die of claim 1, including a data parser receiving indication of whether the mode signal has the first value or the second value via one of a data packet and serial input/output path.

8. A fluidic die comprising:

a plurality of primitives arranged to form a number of primitive zones, each primitive zone including:

a memory to store adjustment data; and at least one signal adjuster to:

receive a fire signal; and adjust the fire signal based on the adjustment data stored in the memory to provide an adjusted fire signal to each primitive of the primitive zone; and a mode line to communicate a mode signal having a first value or a second value; and mode circuitry to direct:

actuation data from each data line to the corresponding primitive when the mode signal has the first value; and for each primitive zone, adjustment data to the memory from data lines corresponding to primitives of the primitive zone when the mode signal has the second value.

9. The fluidic die of claim 8, the mode circuitry to disable the fire signal when the mode signal has the second value.

10. The fluidic die of claim 8, each primitive zone including a plurality of signal adjusters, each signal adjuster of the plurality of signal adjusters corresponding to a different primitive of the primitive zone.

11. The fluidic die of claim 8, the fire signal including a precursor pulse and a fire pulse, the adjustment data including at least one of precursor pulse data representative of how to adjust a duration of the precursor pulse and fire pulse data representative of how to adjust a duration of the fire pulse.

12. The fluidic die of claim 8, including a data parser receiving indication of whether the mode signal has the first value or the second value via one of a data packet and a serial input/output path.

13. A method of operating a fluidic die having a plurality of primitives arranged to form a number of primitive zones with each primitive zone including a memory to store adjustment data and having at least one signal adjuster to adjust a fire signal based on the stored adjustment data to provide an adjusted fire signal to each primitive of the primitive zone, the method including:

directing adjustment data from one of an address bus and a set of data lines to at least one of the memories of the primitive zones during a program mode of operation; and directing address data from the address bus and actuation data to each primitive from a corresponding data line of the set of data lines during a non-program mode of operation.

14. The method of claim 13, including:

disabling the fire signal when in the program mode.

15. The method of claim 13, including:

receiving indication of the program mode via one of a data packet and a serial input/output path.

* * * * *